US008851147B2

(12) United States Patent
Drifka et al.

(10) Patent No.: US 8,851,147 B2
(45) **Date of Patent: *Oct. 7, 2014**

(54) SEGMENTED WIND LOCK CONFIGURATION FOR OVERHEAD ROLL-UP DOORS AND METHOD OF CONSTRUCTING THE SAME

(75) Inventors: Brian Norbert Drifka, Richfield, WI (US); Christopher Gontarski, Sugar Hill, GA (US)

(73) Assignee: Rytec Corporation, Jackson, WI (US)

( * ) Notice: Subject to any disclaimer, the term of this patent is extended or adjusted under 35 U.S.C. 154(b) by 33 days.

This patent is subject to a terminal disclaimer.

(21) Appl. No.: 13/275,403

(22) Filed: Oct. 18, 2011

(65) Prior Publication Data

US 2012/0241110 A1 Sep. 27, 2012

Related U.S. Application Data

(60) Provisional application No. 61/466,922, filed on Mar. 23, 2011, provisional application No. 61/534,356, filed on Sep. 13, 2011.

(51) Int. Cl.
*E06B 9/56* (2006.01)

(52) U.S. Cl.
USPC ..... 160/273.1; 160/268.1

(58) Field of Classification Search
USPC ..... 160/264, 273.1, 268.1, 271
See application file for complete search history.

(56) References Cited

U.S. PATENT DOCUMENTS

| | | | |
|---|---|---|---|
| 436,900 | A | 9/1890 | Morrison |
| 528,071 | A | 10/1894 | Branshaw |
| 766,541 | A | 8/1904 | Spiegle |
| 1,393,405 | A | 10/1921 | Soteros et al. |
| 3,489,200 | A | 1/1970 | Recchione |
| 3,864,203 | A | 2/1975 | Marzocchi |
| 4,357,978 | A | 11/1982 | Keller et al. |
| 4,478,268 | A | 10/1984 | Palmer |
| 4,601,320 | A | 7/1986 | Taylor |

(Continued)

FOREIGN PATENT DOCUMENTS

| | | | |
|---|---|---|---|
| GB | 2137271 | A | 10/1984 |
| WO | WO 03/106805 | * | 12/2003 |

OTHER PUBLICATIONS

International Search Report and Written Opinion for International Application No. PCT/US2012/024283 dated May 23, 2012, 15 pages.

*Primary Examiner* — Blair M. Johnson
(74) *Attorney, Agent, or Firm* — Factor Intellectual Property Law Group, Ltd.

(57) ABSTRACT

An overhead roll-up door assembly for a vertically moving door to permit and prohibit access to an opening, the door assembly having a door panel with two faces and opposing marginal and lateral edges, and at least two wind locks attached proximate each marginal edge. The at least two wind locks extend away from one face of the door panel in a direction substantially perpendicular thereto, and are spaced apart vertically along each respective side edge of the door panel. The assembly further includes a drum for winding and unwinding the door panel to permit and prohibit access to the opening, and, a pair of opposing parallel side columns aligned and spaced apart such that each of the opposing side edges engage one of the side columns in a manner in which at least a portion of the side columns guide vertical movement of the door panel.

10 Claims, 5 Drawing Sheets

(56) References Cited

U.S. PATENT DOCUMENTS

| | | | | | |
|---|---|---|---|---|---|
| 4,649,981 | A | | 3/1987 | Bibeau | |
| 4,690,195 | A | | 9/1987 | Taylor | |
| 4,987,943 | A | | 1/1991 | Charest | |
| 5,131,450 | A | | 7/1992 | Lichy | |
| 5,163,495 | A | | 11/1992 | Lichy | |
| 5,351,742 | A | | 10/1994 | Lichy | |
| 5,365,993 | A | | 11/1994 | Jella | |
| 5,379,823 | A | | 1/1995 | Kraeutler | |
| 5,392,836 | A | * | 2/1995 | West et al. | 160/273.1 |
| 5,445,209 | A | | 8/1995 | Lichy | |
| 5,482,104 | A | | 1/1996 | Lichy | |
| 5,657,805 | A | | 8/1997 | Magro | |
| 5,964,270 | A | * | 10/1999 | Kirkey et al. | 160/273.1 |
| 6,065,525 | A | | 5/2000 | Wells | |
| 6,068,040 | A | | 5/2000 | Magro et al. | |
| 6,152,208 | A | | 11/2000 | Kalempa et al. | |
| 6,341,639 | B1 | | 1/2002 | Mullet et al. | |
| 6,390,171 | B2 | | 5/2002 | Drifka et al. | |
| 6,431,250 | B2 | | 8/2002 | Mullet et al. | |
| 6,574,832 | B1 | | 6/2003 | Boerger et al. | |
| 6,722,416 | B2 | | 4/2004 | Varley et al. | |
| 6,942,003 | B2 | | 9/2005 | Thompson | |
| 7,028,738 | B2 | | 4/2006 | Ceccofiglio | |
| 7,131,481 | B2 | | 11/2006 | Varley et al. | |
| 7,231,953 | B2 | | 6/2007 | Varley et al. | |
| 7,275,581 | B2 | | 10/2007 | Coenraets | |
| 7,464,743 | B1 | | 12/2008 | Berger, Jr. | |
| 7,516,770 | B2 | * | 4/2009 | Jerry | 160/267.1 |
| 7,581,578 | B2 | | 9/2009 | Coenraets | |
| 7,748,431 | B2 | * | 7/2010 | Jansen et al. | 160/268.1 |
| 7,793,702 | B2 | | 9/2010 | Biewer et al. | |
| 7,841,377 | B2 | | 11/2010 | Coenraets | |
| 8,109,317 | B2 | | 2/2012 | Bostyn | |
| 8,291,960 | B2 | | 10/2012 | Bowman | |
| 2006/0144530 | A1 | | 7/2006 | Nagare et al. | |
| 2008/0035282 | A1 | | 2/2008 | Coenraets | |
| 2008/0093037 | A1 | | 4/2008 | Kraeutler | |
| 2009/0145559 | A1 | | 6/2009 | Glasl et al. | |
| 2010/0000692 | A1 | | 1/2010 | Coenraets | |
| 2010/0288452 | A1 | | 11/2010 | Coenraets | |
| 2010/0326607 | A1 | | 12/2010 | Kitani et al. | |
| 2011/0259530 | A1 | | 10/2011 | Brook et al. | |
| 2012/0325416 | A1 | | 12/2012 | Hayashiguchi | |
| 2013/0061525 | A1 | | 3/2013 | Drifka | |

* cited by examiner 12
28
26
D
28
24
22
14
28
D
26
24
28

28
28
12
14
28

12
34
38
28
40

12
34
24
28

12
34
24
28

16
12
34
44
42
38
24
40
28

SEGMENTED WIND LOCK CONFIGURATION FOR OVERHEAD ROLL-UP DOORS AND METHOD OF CONSTRUCTING THE SAME

RELATED APPLICATIONS

This application claims priority to U.S. Provisional Application Ser. No. 61/466,922 entitled "Segmented Wind Lock Configuration For Overhead Roll-Up Doors And Method Of Using Same" filed Mar. 23, 2011; and, U.S. Provisional Application Ser. No. 61/534,356 entitled "Continuous Wind Lock Configuration For Overhead Roll-Up Door" filed Sep. 13, 2011—the contents of both of which are fully incorporated herein by reference.

FIELD OF THE INVENTION

The present invention is related to overhead roll-up doors, and more specifically to a door panel for any overhead roll-up door having a segmented wind lock for preventing the door panel from disengaging with the door assembly from the force of wind.

BACKGROUND OF THE INVENTION

Overhead roll-up doors provide resistance to high winds and/or air pressure. These doors typically include a door panel having opposing side edges that engage with, and are vertically guided in, side columns. In order to enhance the door's resistance to high winds and/or air pressure, the opposing side edges of the door panel may include a continuous thickened edge engage the side columns when high winds "impact" the door panel. However, there are at least three major drawbacks to using these known continuous thickened side edges.

For example, these overhead roll-up doors are typically installed in high-traffic areas with the potential to be impacted by objects or vehicles when the door is opening or closing. While many of these doors include features which allow the door panel to disengage when impacted with such a force, when a continuous thickened edge is applied to the opposing side edges of the door panel the opposing edges may become stuck or jammed in the side columns. If the continuous thickened edges become jammed in the side columns, the door panel may not be able to fully disengage from the side columns, increasing the likelihood of damage to the side columns, the door panel, the thickened edges, or other components associated with the door panel, like for example a bottom bar. In addition, if these thickened side edges become stuck or jammed in the side column, the sticking or jamming may prevent the motor from raising the door panel, potentially damaging the motor and preventing any self-repair features of the door panel from working. In order to repair such doors and get the door panel vertically moving again, frequently a portion of the side column must be removed so the continuous thickened edge can be un-jammed and placed back in the path of travel in the side column.

Another problem with the utilization of continuous wind locks is that they typically substantially increase the diameter of the door panel when it is substantially fully wound on the drum in a substantially open position. The larger diameter requires a larger header which may be more costly and consequently may result in a smaller opening.

Still another drawback to using continuous thickened edges is that continuous thickened edges may increase the total weight of the door, creating additional stress on the motor controlling the door as it moves vertically.

In other prior art door designs, in order to enhance the wind lock of the door panel, small knobs or protrusions may be placed proximate opposing edges of the door panel. These knobs or protrusions typically engage a portion of a side column guiding the door, increasing the resistance of the door in response to force from wind or air pressure on the door. However, these knobs or protrusions may offer less resistance than is necessary, and, under extreme forces, like for example high winds or forces imparted by objects impacting the door panel, thereby resulting in such knobs or protrusions breaking away from the door panel, eliminating any wind load resistance benefit they provide. In order to realize the advantages of the knobs and protrusions once they have been broken away, the knobs or protrusions must be replaced on the door panel, requiring that the engaged edge of the panel be exposed by either disengaging the door panel or removing a portion of the side column, rendering the door inoperable during the replacement process.

Therefore, it would be advantageous to design an overhead roll-up door assembly and panel having a wind lock capable of providing necessary wind load resistance while allowing for maximum breakaway-ability if the door panel is impacted by an object.

It would be further advantageous if the wind lock utilized in the door assembly and panel was capable of winding on a drum without a substantially increased diameter, necessitating the use of a larger header, thereby reducing the size of the opening.

It would be further advantageous if the wind lock utilized in the door assembly could be made light weight to reduce strain on any motors used to vertically move the door panel.

The present invention is directed to solving these and other problems.

SUMMARY OF THE INVENTION

The present invention is directed to a door assembly and door panel having a segmented, thickened edge wind lock to increase the wind load resistance of an overhead roll-up door while maintaining substantial breakaway-ability or disengage-ability. According to one aspect of the invention, an overhead roll-up door assembly for a vertically moving door to permit and prohibit access to an opening is provided. The door assembly includes a door panel having two faces, a top edge, a bottom edge, and opposing marginal and side edges, a drum for winding and unwinding the door panel to permit and prohibit access to the opening, and a pair of opposing parallel side columns aligned and spaced apart such that each of the opposing marginal edges engage one of the side columns in a manner in which at least a portion of the side columns guide the vertical travel of the door panel as the door opens and closes.

According to another aspect of the invention, at least two vertically spaced thickened edge wind locks capable of engaging a portion of a respective side column are attached proximate each marginal edge of the door panel. Providing the at least two spaced apart wind locks along each edge of the door panel increases the wind load resistance of the door panel as the door is opening and closing as the wind locks provide an increased thickness within the side columns, preventing disengagement of the door panel as a result of a wind load being applied to it, while providing substantial breakaway-ability if the door panel is impacted by an object as only portions of thickened edges rather than a continuous thickened edge must be pulled through the side columns.

According to another aspect of the invention, the wind locks may include a thickened body, an angled face facing the interior of the opening configured to engage a portion of the respective side column, and a substantially straight portion extending substantially perpendicular from a face of the door panel, the substantially straight portion being aligned with a lateral edge of the door panel. Angling an engaging face of the wind lock may help maintain substantial disengage-ability of the wind lock and door panel should the door or any of its components be impacted by an object.

According to a further aspect of the invention, the thickness of each wind lock and the vertical distance each wind lock extends along the face of the door panel may be adjusted to meet the wind load and breakaway characteristics of the door and door panel. Providing a thicker and/or longer wind lock increases the size and surface area of the wind lock, providing additional resistance to wind or air pressure against the door panel. In situations where less wind load resistance and more disengage-ability is required, as should be appreciated by those having skill in the art, either one or both of the thickness or vertical length of the wind lock may be reduced to reduce the surface area and amount of wind lock that must pass through the side column should the door or any of its components be impacted by an object.

According to another aspect of the invention, the wind locks may be made of a compressible, resilient material. Using a compressible, resilient material for the wind locks, like for example rubber, foam, or polyvinyl chloride ("PVC"), provides enough stiffness for the wind locks to prevent disengagement of the door panel as a result of wind load or air pressure, while at the same time maintaining disengage-ability should the door or any of its components be impacted by an object—as the wind locks may compress to better fit through the side column gap to disengage. Other materials can likewise be used, as would be readily understood by those having ordinary skill in the art, According to still another aspect of the invention, the door assembly may further include a material covering at least a portion of the wind locks, and in some cases, at least a portion of the door panel along the marginal edge between each wind lock. Covering the wind locks and marginal edges of the door panel with a material having a lower resistance than the wind locks or door panel, like for example covering a rubber door panel and rubber or PVC wind lock with a fabric or a plastic material, may assist in reducing the friction between the wind locks and the side columns of the door panel to help maintain disengage-ability. Covering portions of the door panel and/or the wind locks with a friction reducing material also has the added benefit of protecting the door panel and/or wind locks from the forces of friction, reducing the amount of wear on the door panel and/or wind locks resulting from engagement with the side columns.

According to another aspect of the invention, a strip of material may be attached on the face of the door panel to which the wind locks are not attached, i.e. the face opposite the wind locks. As with covering at least portions of the wind locks and/or the door panel there between, placing a material like fabric or plastic over the opposite face of the door panel may reduce the friction between the side columns on the door panel, protecting the door panel from wear and maintaining disengage-ability, while at the same time increasing a total thickness of the door panel, thereby marginally increasing the wind load resistance of the same.

Other aspects and features of the invention will become apparent to those having ordinarily skill in the art upon review of the following Description, Claims, and associated Drawings.

DETAILED DESCRIPTION OF THE PRESENT INVENTION

Figure 1:
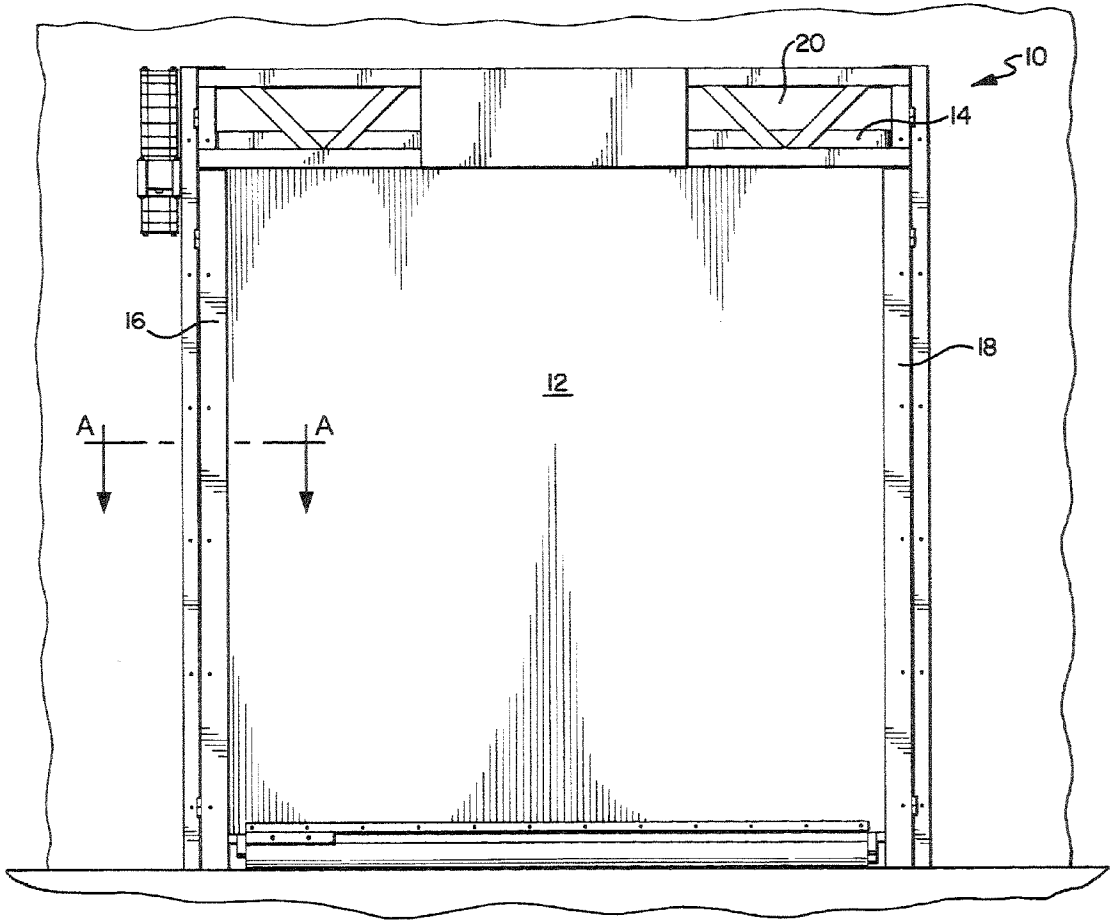
FIG. 1 is a front view of a door assembly as contemplated by the invention.

While the present invention is susceptible of embodiment in many different forms, there is shown in the drawings and will herein be described in detail, preferred embodiments of the invention with the understanding that the present disclosure is to be considered as an exemplification of the principles of the invention and is not intended to limit the broad aspect of the invention to the embodiments illustrated.

FIG. 1 shows a door assembly 10 having door panel 12, drum 14 for winding and unwinding door panel 12 to permit and prohibit access to an opening, side columns 16, 18 which engage a marginal edge of door panel 12 (and which further guide door panel 12 between the open and closed position) and header 20 for housing drum 14 and any unrolled portion of door panel 12.

Figure 2:
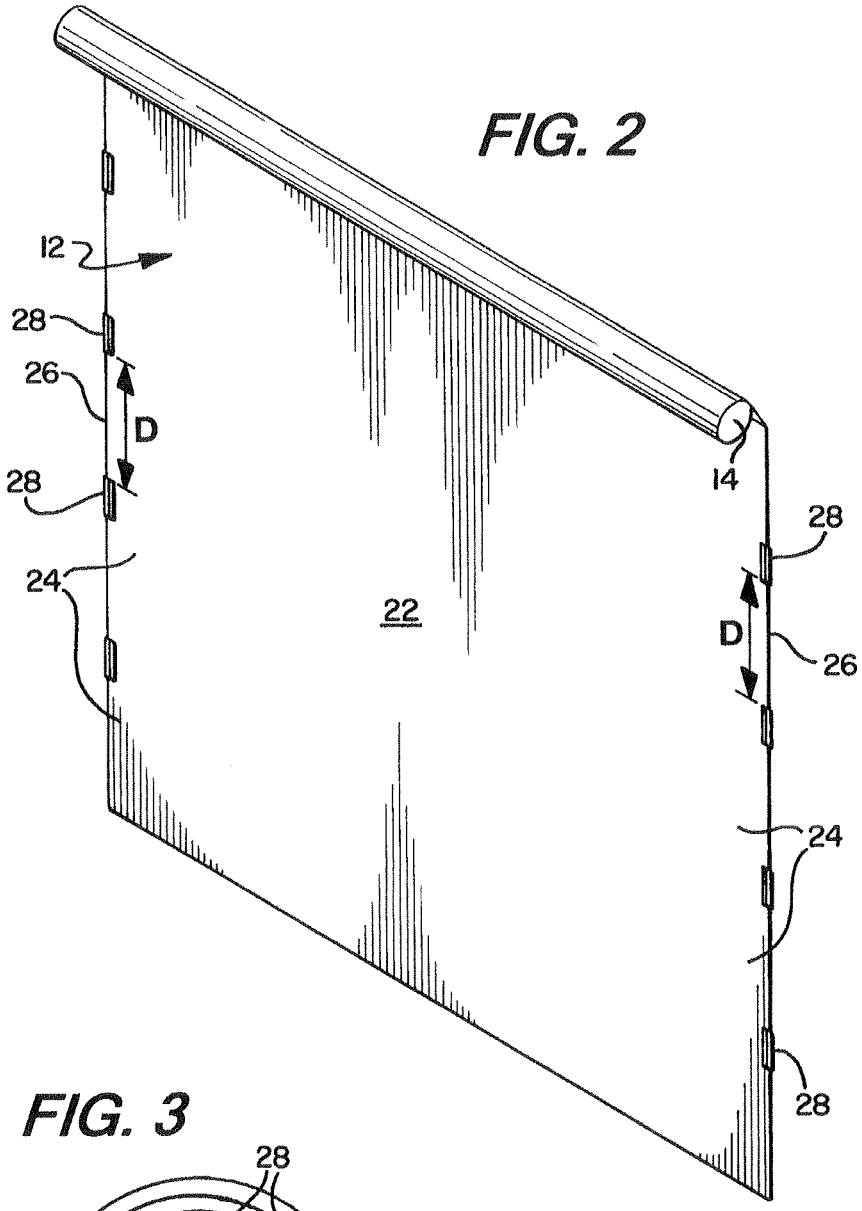
FIG. 2 is perspective view of a door panel as contemplated by the invention.

FIG. 2 shows an isolated view of door panel 12 and drum 14 as contemplated by an embodiment of the invention. As seen in FIG. 2, door panel 12 includes a first face 22, opposing marginal edges 24 and opposing lateral edges 26. As should be appreciated by those having ordinary skill in the art, door panel 12 may be made of any flexible material known in the art, like for example rubber or any fabric or nylon material capable of use in an overhead roll-up door panel.

Attached to face 22 and vertically spaced distance D along each opposing marginal edge 24 are at least two thickened edge wind locks 28. While shown in FIG. 2 as four wind locks attached along each marginal edge, it is contemplated by the invention that the number of wind locks and spacing between each wind lock may be adjusted to meet the requirements of the door panel where the door is installed. For example, in environments where a door panel will encounter large wind loads, a greater number of wind locks may be attached to each marginal edge and/or the distance between each wind lock substantially may be reduced. Conversely, where smaller wind loads are encountered by the door panel, the number of wind locks may be reduced and/or the distance between each wind lock may be increased. Utilizing fewer wind locks and/or increasing the distance between each wind lock is particularly advantageous in locations where wind load is small but traffic through the opening or doorway blocked by the door panel is high. Fewer wind locks and/or a greater distance between each wind lock makes disengagement substantially easier if the door panel or any parts associated therewith are impacted by an object or vehicle passing through the opening as there are less thickened portions which must be pulled through the side column gap. In addition to allowing for better disengage-ability than continuous wind locks, it should be appreciated by those having ordinary skill in the art that segmenting the wind locks also reduces the weight of the door panel, thereby reducing the stress on the motor and other components used to open and close the door panel.

Figure 3:
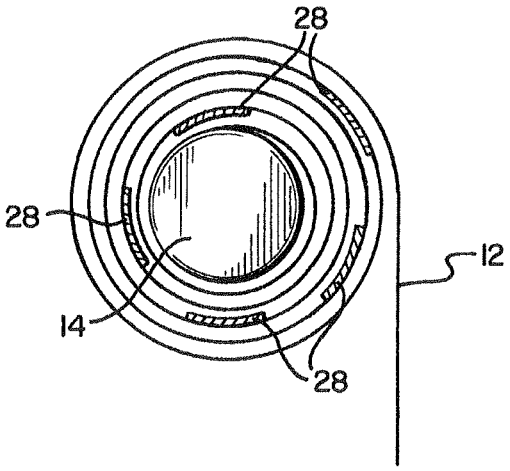
FIG. 3 is side view of the door panel in a substantially open position as contemplated by this invention.

Regardless of the spacing or number of wind locks attached to door panel 12, it is contemplated by the invention that wind locks 28 should be substantially spaced so that the wind locks do not overlap each other when door panel 12 is in a substantially open or rolled position, as shown in FIG. 3. Configuring the wind locks in a manner which substantially eliminates overlap minimizes roll size when the door panel is in a substantially open position, which, in turn, minimizes the size and cost of the header and in turn maximizes the size of the opening. In embodiments where large numbers of wind locks are used in order to increase wind load resistance, it should be appreciated by those having ordinary skill in the art that any resulting overlap should be reduced and minimized by, for example, spacing the wind locks in a manner where only portions of two wind locks overlap at any given point before three or portions of three, wind locks overlap at any point.

Figure 4:
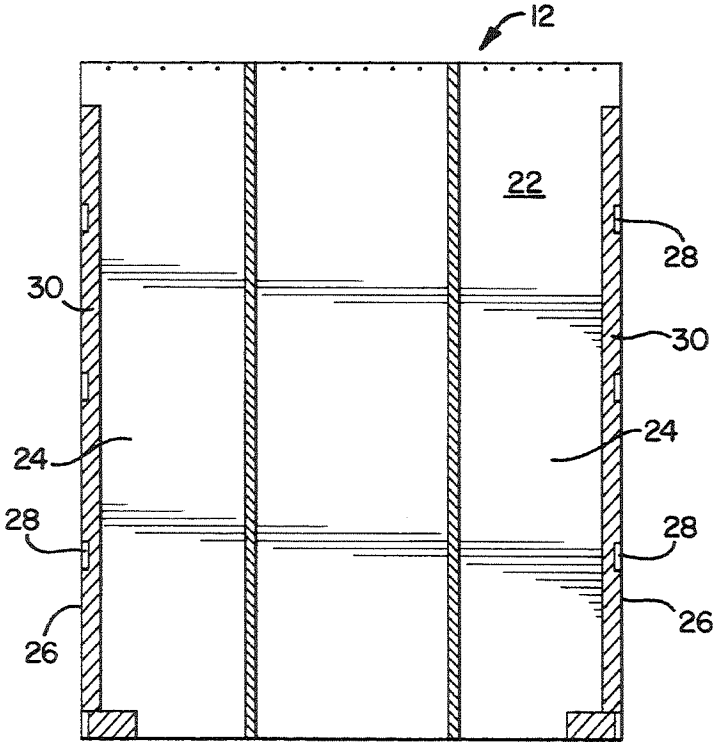
FIG. 4 is a front view of a door panel as contemplated by the invention.

Though wind locks 28 may be attached and left exposed along each marginal edge 24, in a preferred embodiment of the invention friction reducing strips 30 (FIG. 4) may be applied over wind locks 28, and in some embodiments over wind locks 28 and portions of marginal edge 24. Strips 30 may be any flexible, friction reducing material known in the art, like for example Polyethylene Terephthalate ("PET") fabric strips or other polyester or nylon strips capable of being bonded to wind locks 28, and in some embodiments, marginal edges 24. Strips 30 may be bonded in any manner known in the art, including but not limited to the use of adhesives placed on one or both of strips 30 and wind locks 28 and marginal edges 24, the use of chemicals which may react with one or both of the strips or wind locks to create a bonding surface or surfaces, or through the use of heat.

Attaching friction reducing strips 30 over wind locks 28, and in some embodiments marginal edges 24, serves two important functions. First, the strips reduce the coefficient of friction between the wind locks and the respective side column 16 or 18, enhancing the ability of the wind locks and door panel 12 to disengage from the side columns if the door panel or any associated structures are impacted by an object or vehicle. The friction reducing strips may engage or contact the side columns and slip out easier than uncovered wind locks or uncovered portions of the marginal edges so as to avoid damage to the door panel, other door components and any objects or vehicles impacting the door.

Furthermore, strips 30 reduce wear on wind locks 28 and marginal edges 24 resulting from engagement with side columns 16, 18. When a wind load is applied to door panel 12, or an object or vehicle impacts the door panel, the wind locks, and in some cases the marginal edges, will engage the side columns and rub there against. Without the strips, the resulting friction from the engagement of the wind locks and marginal edges and the side columns may result in the wind locks or marginal edges of the door panel becoming worn and less effective or ultimately failing. In embodiments where strips are utilized, the wear may be avoided or at least substantially reduced, leading to a better operating, and longer lasting door and door panel.

Figure 5:
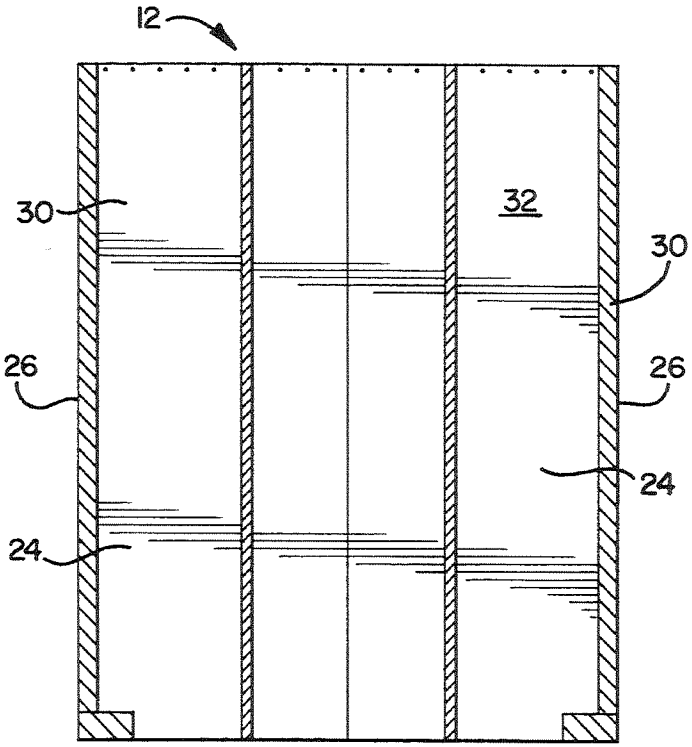
FIG. 5 is rear view of a door panel as contemplated by the invention.

In order to more fully recognize the advantages associated with using strips 30, in addition to applying the strips along the marginal edges on the face of the door panel to which wind locks 28 are attached to (shown in FIG. 4 as first face 22), in some embodiments it may be advantageous to attach or apply the strips along the opposite face (shown in FIG. 5 as second face 32) along the marginal edges. Attaching strips along the marginal edges of both the first face and the second face regardless of which face the wind locks are attached, further reduces friction between the marginal edges of the door panel and the side columns, maintaining or enhancing the disengage-ability of the door panel if impacted by an object or vehicle while also extending the life and operability of the door panel by substantially reducing the wear friction on both sides of the door panel.

It should be appreciated by those having ordinary skill in the art that the environment and location requirements of the door panel may dictate the characteristics of any strips applied to the wind locks and/or marginal edges. For example, in environments and locations where a door panel is going to encounter high wind loads but less object or vehicle traffic, it may be advantageous to use strips having a higher wear resistance and are capable of withstanding increased or constant friction for a substantial period of time before wearing out. Alternatively, in environments or locations with lower wind loads but higher object or vehicle traffic, it may be advantageous to use strips which have a very low coefficient of friction in order to further enhance or maintain the disengage-ability of the door panel. Ideally, however, a fabric having both a high wear resistance and low coefficient of friction is preferred.

Figure 6:
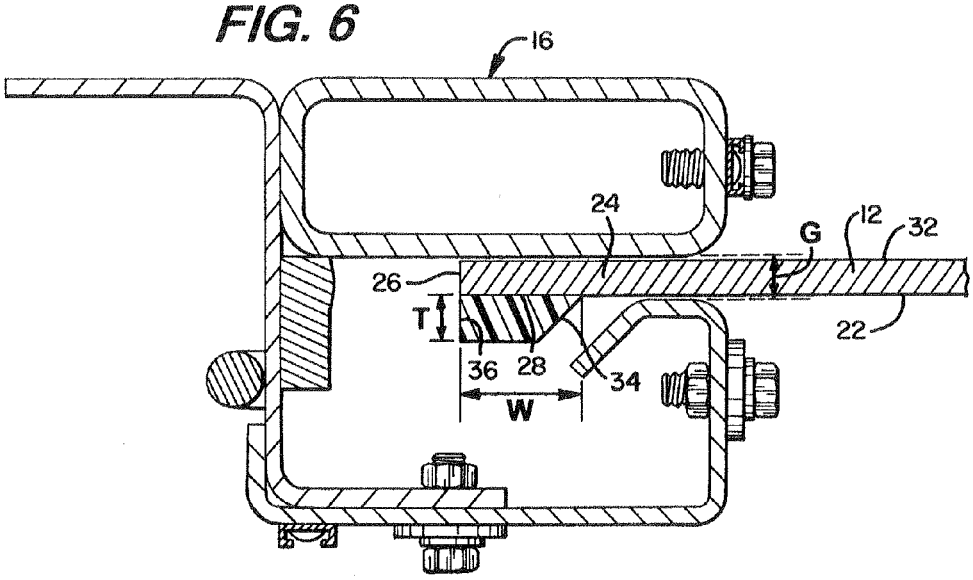
FIG. 6 is a cross-sectional view of the door assembly taken along A-A in FIG. 1.
Figure 7:
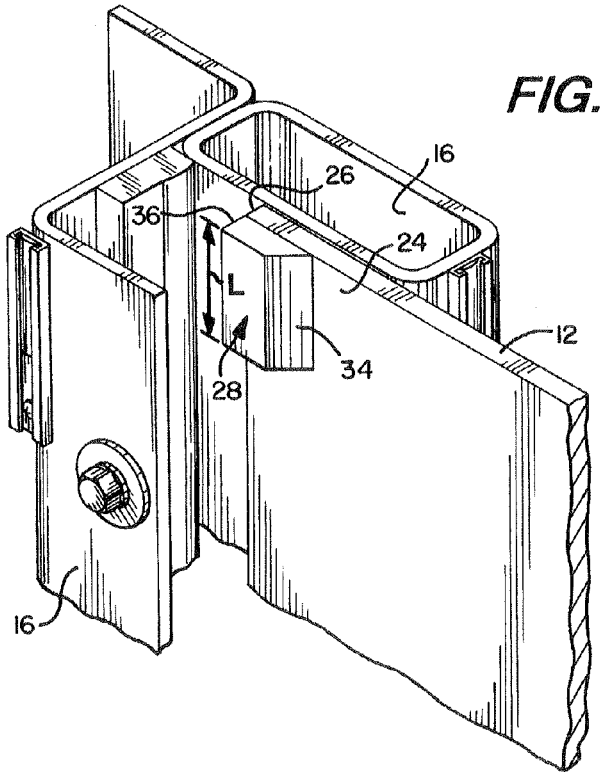
FIG. 7 is a perspective view of FIG. 2 with a portion of a side column removed.

The shape and configuration of wind locks 28 and their engagement with side columns 16 and 18 may be better seen in FIGS. 6 and 7 which are a cross-section view along line A-A of FIG. 1 and a perspective view of FIG. 6 having a portion of side column 16 removed, respectively. As is seen in FIGS. 6 and 7, wind locks 28 are attached to marginal edge 24, have a thickness T, a length L, a width W, and extend substantially perpendicular from a face of door panel 16, shown as first face 22. In a preferred embodiment wind locks 28 each include an angled face 34 and a substantially straight portion, and edge or side 36 which substantially aligns with lateral edge 26 of door panel 12. The wind locks may be made from any resilient material capable of deforming in the face of large forces, like those created by an impact on the door panel. Examples of such materials include, but are not limited to rubber, foam, or polyvinyl chloride ("PVC")

Though wind lock 28 is shown in FIGS. 6 and 7 attached to first face 22, it should be appreciated by those having ordinary skill in the art that side column 16 may be configured in such a manner that wind lock 28 may instead be attached to second face 32.

In a preferred embodiment, angled face 34 is configured to engage a portion of side column 16 and hold door panel 12 in the side column when a wind load is applied to the door panel, while being able to engage and slip out of the slide column if an object or vehicle impacts the door panel or any of its components. In such embodiments, since angled face is configured to be the portion of the wind locks that engage the side columns, in embodiments where strips 30 are also used, it is imperative that the strips are preferably applied to at least the angled face. However, as should be appreciated by those having ordinary skill in the art, it is advantageous to at least cover the entire portion of the wind lock which will have to engage or contact a portion of the side column in order to disengage should the door panel be impacted.

It is further advantageous to reduce wear and friction on the door panel itself in embodiments where the strips are applied to marginal edges 24 that the strips extend horizontally across marginal edges 24 a distance at least equal to at least the distance the edge is contained within the side column. Placing the strips over the marginal edges reduce friction and wear on any part of the door panel which engages the side columns, whether a wind load is applied, an object has impacted the door panel, or through standard opening and closing sequences.

In order to insure wind load resistance and disengage-ability, the relationship between thickness T, gap G in the side column through which the edge of the door panel and the wind lock must escape if the door panel is impacted, and the material or characteristics of the wind lock must be carefully configured. In order to insure the door and door panel have a requisite wind load resistance, it is contemplated by the invention that the thickness of the door panel and thickness T be thicker than the width of gap G in the side column to insure that at least a portion of the wind lock engages the side column under low, moderate, and/or high wind loads.

In order to insure disengage-ability when the door panel is impacted, each wind lock must be sufficiently flexible or pliable to compress its thickness T so the wind lock may fit through the remaining area of gap G under extreme forces, i.e. each wind lock must compress thickness T to at least match the difference between the width of gap G and the thickness of the door panel. In order to further maintain disengage-ability when utilizing the wind locks, it is contemplated by the invention that, in addition, or in the alternative, to the wind locks compressing, that side columns 16, 18 may be sufficiently flexible so as to flex when great force is applied on a portion of them by the wind locks, increasing the width of gap G thereby allowing a thicker wind lock to pass through and disengage.

While it has been discussed herein that the wind load resistance and disengage-ability of the door panel and wind locks may be adjusted by altering the number of wind locks, the distance between each wind lock, or by applying strips to the wind locks and/or door panel having particular properties, it is further contemplated by the invention that the wind load resistance and disengage-ability of the wind locks and door panel may be altered and adjusted to meet environmental or location requirements by adjusting one or more of the length, thickness, and width of each wind lock or the gap G in each side column. As should be appreciated by those having ordinary skill in the art, in environments where high wind load resistance is needed each wind lock may be made longer and/or thicker to create a larger surface or body to hold the door panel in place and creating a larger, thicker body which must be pulled through the side column gap before the door panel disengages.

It is contemplated by the invention that the wind locks may be made of different sizes to accommodate particularly heavy wind loads at particular points, or to create portions capable of more easily disengaging from the side columns if the door panel is impacted. For example, it may be advantageous to utilize smaller wind locks in a lower portion of the door panel in order to make it easier for the lower portion of the door panel to disengage if impacted. Such may be particularly advantageous where a bottom bar or other structure is capable of locking the door panel in place when the door panel is in a substantially closed position.

Another alternative for adjusting the wind load resistance and disengagement characteristics of the wind locks is to alter or adjust the material the wind locks are constructed from. For example, where higher wind load resistance is required, the wind locks may be made of a less pliable or flexible material in order to remain locked in place in the face of the high wind load. Alternatively, where a high level of disengage-ability is required, the wind locks may be configured from a more pliable or flexible material to allow for more deformation and/or compression to escape through the side column gap.

Figures 8A, 8B, 9, 10:
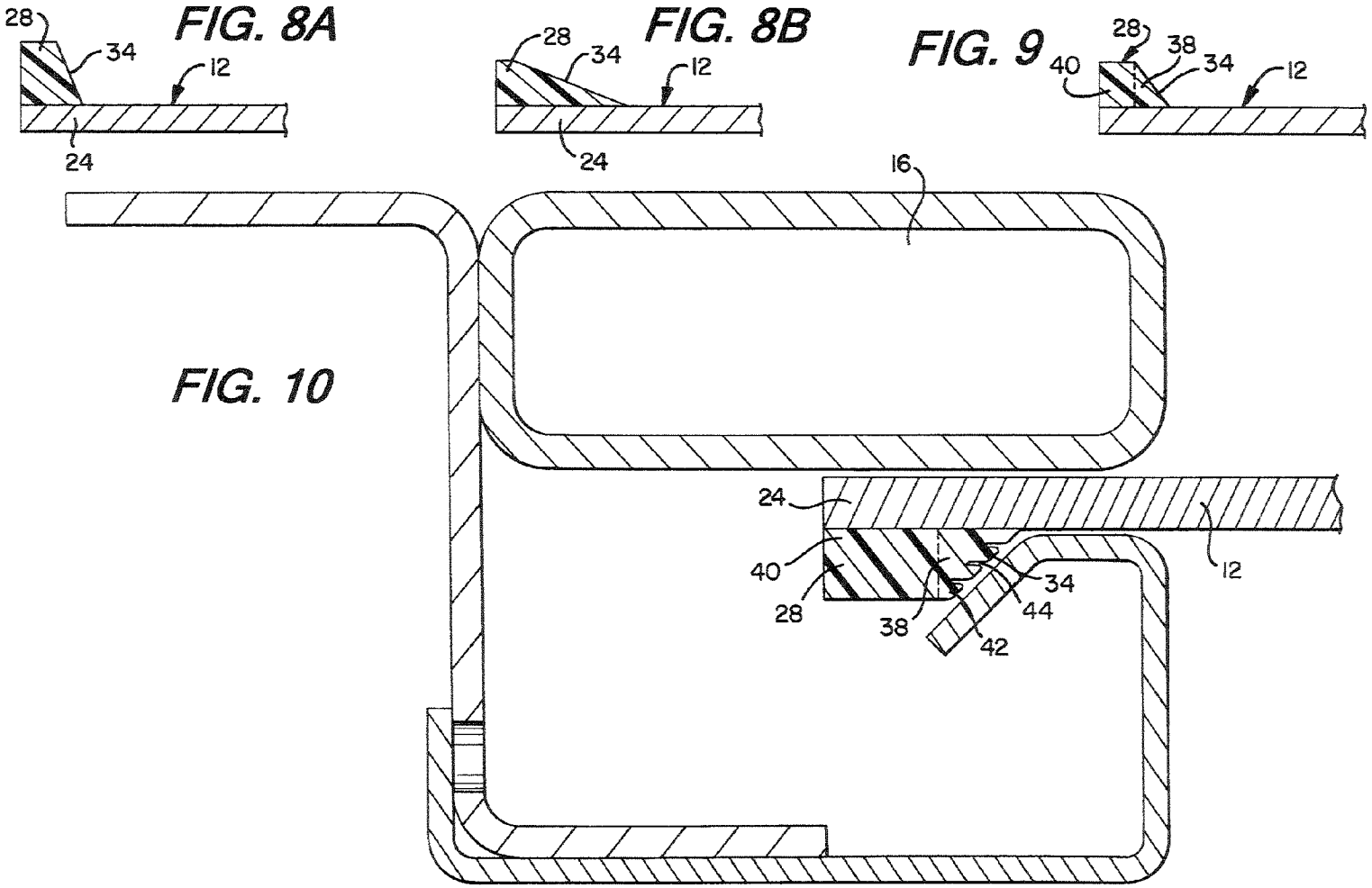
FIG. 8A is a cross-sectional view of the door panel taken along A-A in FIG. 1 showing an embodiment of a wind lock.
FIG. 8B is a cross-sectional view of the door panel taken along A-A in FIG. 1 showing an embodiment of a wind lock.
FIG. 9 is a cross-sectional view of the door panel taken along A-A in FIG. 1 showing an embodiment of a wind lock.
FIG. 10 is a cross-sectional view of the door assembly taken along A-A in FIG. 1 showing an embodiment of a wind lock.

As yet an additional alternative for adjusting the wind load resistance and disengage-ability of the wind locks and door panel, it is further contemplated that the shape, and in particular the angle of the angled portion or face of the wind lock, may be adjusted or modified in order to increase or decrease the wind load resistance. For example, as shown in FIG. 8A, angled face 34 may be angled to be more perpendicular to the surface of the door panel to increase the wind load resistance as a more perpendicular angle will make it more difficult to disengage the wind locks from the side columns. If however, greater disengage-ability is required, the angled face or portion 34 of the wind lock may be flatter and more parallel to the door panel in order to more easily escape through the side column gap and disengage, as shown in FIG. 8B.

Another method of modifying the wind load resistance and disengage-ability of the wind locks and door panel contemplated by the invention is to remove a portion of the body of the wind lock or make a portion of the interior of the wind lock hollow. Creating a hollow portion allows for easier compression, making the disengagement of the wind lock from the side columns much easier if the door panel is impacted by an object or vehicle.

As yet a further alternative to modify the wind load resistance and disengage-ability characteristics of the door panel and wind locks, and as an alternative to using the strips over the wind locks, it is contemplated by the invention that the wind locks may have different durometers. For example, as shown in FIG. 9, a portion of the wind locks which are configured to engage a portion of the side column may have a higher durometer, shown as portion or area 38, to resist wear resulting from frictional forces created through engagement and to create a less flexible portion for withstanding wind loads. While portion 38 is made from a higher durometer material, portion 40 may be made from a lower durometer material in order to more easily compress and allow for disengagement of the wind lock and the door panel if impacted by an objet or vehicle. When impacted, it should be appreciated that the higher durometer portions will deform and disengage from the side column, as will the remaining portion of the wind lock made from a lower durometer.

In order to create wind locks having different durometers, it is contemplated by the invention that the wind locks may be made of a single material which has at least one portion or area which is coated or impregnated with a chemical or substance which reacts with the material to increase or decrease the durometer of the material. It should be appreciated by those having ordinary skill in the art that in some embodiments it may be advantageous to impregnate both the higher and lower durometer portions of the wind lock in order to achieve a desired resistances.

An alternative method of creating a wind lock having different durometers is to co-extrude each wind lock from two materials, one having a higher durometer and one having a lower durometer.

Regardless of how the dual durometer wind lock is created, in order to maintain disengage-ability, it is contemplated by the invention that at least a portion of the higher durometer portion engaging the side column may be ribbed (FIG. 10) or otherwise configured to allow for deformation or compression if the door panel or any of its components are impacted by an object or vehicle to disengage from the side column and prevent damage. In a preferred embodiment, when dual durometer wind locks are used, that the angled face 34 of the wind lock have ribs 42 with channels 44 located there between to allow the ribs to compress if the door panel is impacted by an object. It is contemplated by the invention that the wind load resistance and disengagement capabilities of the wind locks and door panel may be adjusted by adjusting the thickness or number of ribs in such embodiments.

As should be appreciated by those having ordinary skill in the art, any of the methods of increasing and decreasing the wind load resistance based on the number, size, composition, shape, or use of strips described herein may utilized in combination with each other in each wind lock, including characteristics which both increase and decrease the resistance within a single wind lock. While some characteristics may go hand-in-hand—like for example that longer wind locks will necessarily lead to a shorter distance between wind locks, or, a flatter angle on the angled portion will lead to either a wider or thinner (or both) wind lock—it is within the scope of the invention to make, for example, a shorter, thinner wind lock having a more perpendicular angle to achieve and meet the environmental and location requirements.

It should also be appreciated that any of the characteristics of a particular wind lock within a single door panel may be different from at least one other wind lock on the same door panel. While an example is discussed above with respect to altering the length or thickness of a particular wind lock based on the environment and the location of the wind lock on the door panel, it is contemplated that any characteristic of any wind lock may be adjusted to meet environmental, location, and use requirements of a particular door panel.

The above-described embodiments of the present invention are intended to be examples only. Alterations, modifications and variations may be effected to the particular embodiments by those of skill in the art without departing from the scope of the invention, which is defined by the claims appended hereto.

What is claimed is:

1. An overhead roll-up door assembly for a vertically moving door to permit and prohibit access to an opening, the door assembly comprising:

a door panel having two faces and opposing marginal and lateral edges, the door panel having at least two wind locks attached proximate each marginal edge wherein each of the at least two wind locks attached proximate each marginal edge extend away from one face of the door panel in a direction substantially perpendicular thereto, are spaced apart vertically from each other proximate each respective marginal edge of the door panel, and are constructed using materials having at least two different durometers a drum for winding and unwinding the door panel to permit and prohibit access to the opening; and, a pair of opposing substantially parallel side columns aligned and spaced apart such that at least a portion of each of the opposing marginal edges engage one of the opposing substantially parallel side columns in a manner in which at least a portion of each of the opposing substantially parallel side columns guide vertical travel of the door panel as the door opens and closes, wherein each of the at least two wind locks positioned proximate each respective marginal edge of the door panel is configured so that a portion having a higher durometer of the at least two different durometers of each of the at least two wind locks engages a portion of the opposing substantially parallel side columns when a wind load is applied to the door panel.

2. The door assembly of claim 1 wherein each of the least two wind locks attached proximate each marginal edge includes:

a compressible material; and, an angled portion facing the interior of the opening configured to engage a portion of the side column.

3. The door assembly of claim 1 further comprising a strip of material attached proximate each marginal edge on an opposite face of the door panel of that of the wind locks.

4. The door assembly of claim 3 wherein the strip of material attached proximate each marginal edge on the opposite face is substantially continuous from a top edge of the door panel to a bottom edge of the door panel.

5. The door assembly of claim 1 wherein at least three wind locks are attached proximate each of the opposing marginal edges of the door panel.

6. The door assembly of claim 1 wherein at least four wind locks are attached proximate each of the opposing marginal edges of the door panel.

7. The door assembly of claim 1 wherein each of the wind locks includes an angled portion for engaging a portion of the side columns, the angled portion being made of the higher durometer material.

8. The door assembly of claim 7 wherein the angled portion includes a planar face.

9. The door assembly of claim 8 wherein the angled portion includes at least two ribs.

10. The door assembly of claim 1 wherein the at least two wind locks attached proximate each of the opposing marginal edges are a co-extrusion of materials having different durometers.

* * * * *